US006551167B1

(12) United States Patent
Duck

(10) Patent No.: US 6,551,167 B1
(45) Date of Patent: Apr. 22, 2003

(54) PLAYGROUND SPINNING ELEMENT WITH NOISE MAKING DEVICE

(75) Inventor: Amy E. Duck, Fort Payne, AL (US)

(73) Assignee: Playcore Wisconsin Inc., DE (US)

( * ) Notice: Subject to any disclaimer, the term of this patent is extended or adjusted under 35 U.S.C. 154(b) by 0 days.

(21) Appl. No.: 10/119,459

(22) Filed: Apr. 10, 2002

(51) Int. Cl.[7] ..... A63H 1/28

(52) U.S. Cl. ..... 446/265; 446/214; 446/397; 472/56

(58) Field of Search ..... 472/56; 446/236, 446/265, 397, 266, 246, 215, 214

(56) References Cited

U.S. PATENT DOCUMENTS 1,185,341 A * 5/1916 Morse ..... 446/265
2,117,133 A * 5/1938 Bell ..... 446/214
2,807,117 A * 9/1957 Davies ..... 446/265
3,509,659 A * 5/1970 Kau ..... 446/236

* cited by examiner

*Primary Examiner*—Kien T. Nguyen
(74) *Attorney, Agent, or Firm*—Welsh & Katz, Ltd.

(57) ABSTRACT

A playground-spinning element with noise making device for use in association with a playground set is provided. The element allows the user to play using fine motor skills such that the user causes the creation of rain-like sounds by his action. The element also provides interest in that the user, and other viewers, may view the spinning of an interestingly shaped object. In a preferred embodiment, the device housed within a play panel such that it is visible from two sides, and can be accessed by users on both sides of the panel.

10 Claims, 1 Drawing Sheet

PLAYGROUND SPINNING ELEMENT WITH NOISE MAKING DEVICE

FIELD OF THE INVENTION

The present invention concerns a novel entertainment system, for use in association with children's playground equipment, which allows a child to create interesting noises and have an interesting spinning feature within a playground activity center. More particularly the present invention concerns a panel, for use on or within a playground, having a play element that may be spun about an axis such that it creates interesting noises.

BACKGROUND OF THE INVENTION

Children's recreation centers such as jungle gyms, swing sets, tree houses and forts are common on playgrounds, back yards, public parks and recreation centers. However, most of these recreation systems are designed for mere functionality, displaying the structural elements on which children are to climb upon and play within. Most such systems do not include aspects that make the recreation system whimsical or fun on its own nor do they include aspects that permit children to exercise their minds as well as their bodies.

The present invention is a play feature that can be included in playground sets such that a child can break periods of physical play with moments of more quite intellectual play. The present invention includes play aspects that allow a child to work with his mind and makes the entire playground experience challenging and entertaining. In the present invention a panel having a noise making tube journaled to an axis is provided such that by spinning a handle attached to the axis, to which the tube is journaled, the child can cause the noise making tube to spin, thereby making noise. More specifically, the present invention comprises a device that a child may spin and cause a rain-like noise to be created.

The present invention allows children who are playing in a physical playground surrounding to take time from the physical elements of the playground to enjoy a more intimate variety of play that includes use of finer motor skills and rewards the user by allowing, as result of the use of the device, for the creation of a natural sounding rain noise.

Other objects and advantages of the present invention will become apparent as the description proceeds.

SUMMARY OF THE INVENTION

In accordance with the present invention, a playground entertainment feature, comprising a tubular member, having internal walls defining an internal space, is provided. The tubular member is journaled to a central axis such that the tube may spin freely. The internal space within the tube houses an interference member and a plurality of small noise members therein. The interference member and the small noise members being freely associatable within the tubular member such that when the tubular member is rotated about the central axis the small noise members and the interference member collide with each other and the inner walls of the tubular member to create sounds.

In a preferred embodiment, the playground feature is housed in a panel that may be attached to the base elements of a typical playground. Within the panel, the playground feature of the present invention may be housed in a clear "bubble" of plastic material such that the inner device is protected from the elements and rough play and is viewable by the person playing with the feature. In a preferred embodiment, the tubular member is created of metal and houses, within its walls an interference member and interference member striking objects. In a preferred embodiment, the interference member is a helical-spring shaped device with a diameter (along its long axis) smaller than the internal diameter of the tubular member. In this preferred embodiment, the interference member is made of a metal, or similar material, which allows the device to be light-weight and permits the making of noise when it is struck by the striking objects. The striking objects, in a preferred embodiment, are typically BB's and/or other types of generally spherically shaped pieces that move between the spaces of the interference member and the inner space of the tubular member. In another embodiment, the tubular member is created of plastic and houses, within its walls an interference member and interference member striking objects. In a preferred embodiment, the spherically shaped members are metal, such as BB's or other small spheroids or ball bearings. In another preferred embodiment, the spherically shaped members are made of plastic. The spheres strike the inner-walls of the tubular member and the interference member in such a manner as to make a noise reminiscent of the noise that rain makes.

In an embodiment, the interference member is made of hard plastic, or similar material, which allows the device to be light-weight and permits the making of noise when it is struck by the striking object. While metal is used in one preferred embodiment and plastic materials are used in another embodiment, it will be understood, by persons having skill in the art that any material, having similar properties, such as those desirable in a noise making device, may be used without departing from the novel scope of the present invention.

In one embodiment, the device includes four tubular members, each having an arcuate shape and being attached at one end to an axle, forming a pinwheel-like shape. Each of the tubular members has an interference device and a plurality of striking members. It will be understood by persons having skill in the art that while four members are shown (in the following figures) and described, any number of tubular members and/or tubular members having shapes other that arcuate may be used without departing from the novel scope of the present invention.

In a preferred embodiment, the pin-wheel shaped tubular structure is housed in a bubble-like container, preferably made of transparent plastic material. A handle, allowing the user to comfortable grasp the center axis of the tubular structure is provided such that the user may spin the pin-wheel structure without touching the tubular elements is provided. A rod-like device is provided near the axis of rotation of the pin-wheel structure, such that the axis emerges through the protective transparent bubble-shield. A comfortable handle is provided at the free end of the rod-like device. In one embodiment, the panel allows the viewer to view and spin the pin-wheel like structure from the front and the back. In this embodiment, transparent panels are provided on the front and back of the device and the rod-like device extends through both panels and is provided with a handle on each side.

A more detailed explanation of the invention is provided in the following description and claims and is illustrated in the accompanying drawings.

DETAILED DESCRIPTION OF THE ILLUSTRATIVE EMBODIMENT

Figure 1:
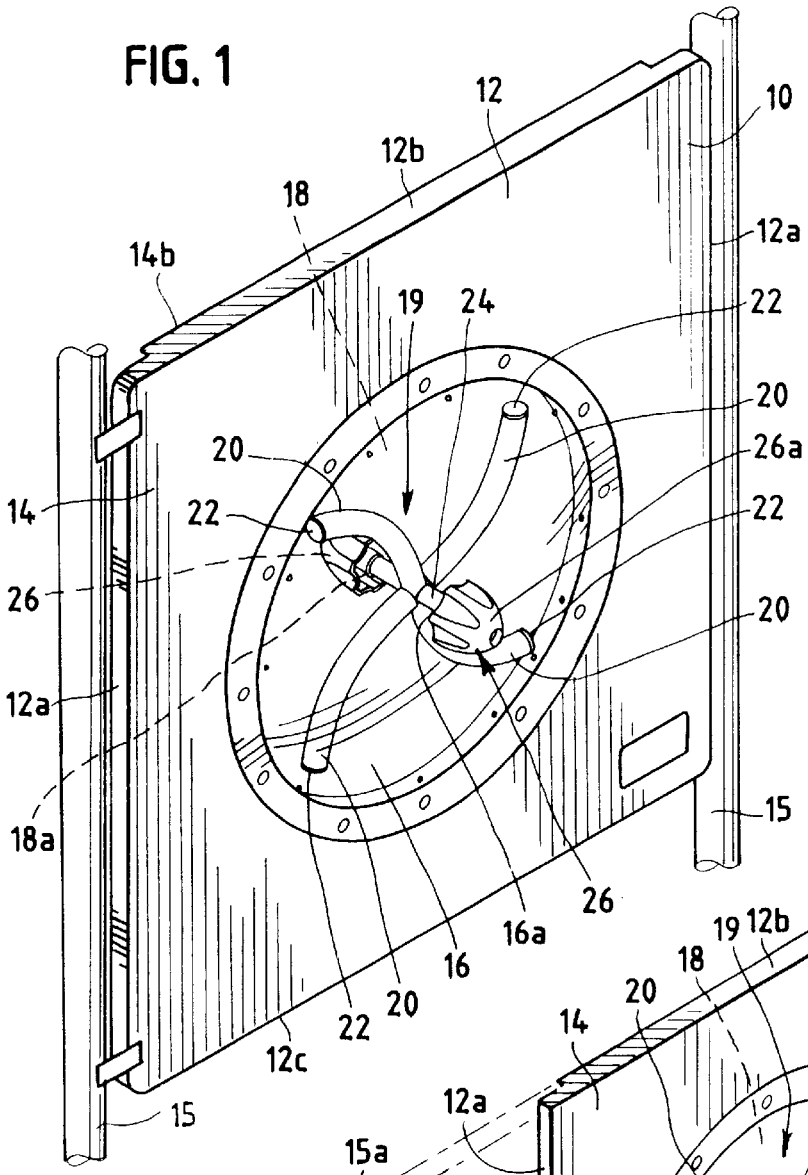
FIG. 1 is a perspective view of a play panel of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Referring now to the Figures, in FIG. 1 a panel 10, having an embodiment of a play feature 12 built into it, is shown. In the illustrative embodiment, the panel is comprised of a wall 14 having a front side 14*a* and a rear side 14*b*. Wall 14 defines an opening 16 into which play feature 12 is installed. In a preferred embodiment, wall 14 is comprised of a hard durable piece of plastic that can withstand conditions typically found in temperate zones. It is to be understood that wall 14 may be constructed of any material which provides structural stability and durability, without departing from the novel scope of the present invention.

As will be known by persons having skill in the art, typically (but not exclusively) such play features, as feature 12, are constructed as a part of larger playgrounds or play sets (not shown). Generally, play features, such as feature 12, are secondary play implements and can be located in a variety of places within a playground. In FIG. 1, posts 15 are shown. It will be seen that posts 15 can be extended either to place play feature 12 in an elevated position, so that it may be used by a player on an elevated level of a playground, or extended such that the posts 15 extend above play feature 12, so that feature 12 is on a ground level and the post 15 can help support another, elevated, level. It will also be understood, by persons having skill in the art, that posts 15 may solely support play feature 12 and be capped just above the levels shown. In this latter manner, play feature 12 can be a stand-alone play feature. It will be understood by persons having skill in the art, that posts 15 can be constructed of any strong and durable materials, including plastic, wood, steel or composite materials, without departing from the novel scope of the present invention.

Figure 4:
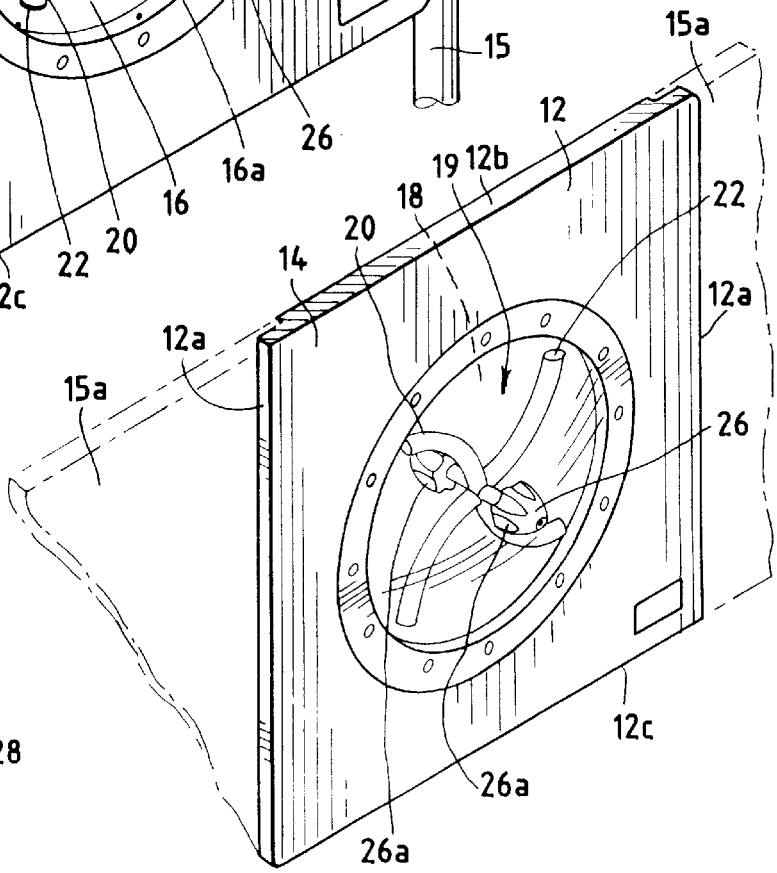
FIG. 4 is a perspective view of another play panel of the present invention.

In contrast, as shown in FIG. 4, feature 12 may be made part of continuous walls 15*a* and thereby set at any convenient place or places in a playground or in any child play environment. It will be understood by persons having skill in the art, that walls 15*a* may be constructed in any manner known in the art, and that one wall 15*a*, on only one side of the pay feature, may be used instead of one on each side, without departing from the novel scope of the present invention. Further, play feature 12 may be made part of larger continuous wall, wherein it would be surrounded by a wall or wall elements on each end 12*a*, and/or at the top 12*b* and bottom 12*c*, without departing from the novel scope of the present invention.

Play feature 12 comprises a first cover-section 16 and a second cover-section 18, each defining an opening at its respective apex 16*a* and 18*a*. As shown in FIG. 1, cover-section 18 is a fractional portion of a spherical member, or similarly shaped "bubble-shaped" member, formed to an appropriate depth such that the interior members can rotate freely, as will be described in detail below. In a preferred embodiment, the cover-sections 16 and 18 are constructed of durable clear plastic material, such that the interior of the sphere-like member can be viewed. It will be understood, by persons having skill in the art, that any clear material, which can be formed into cover-sections, or similar "bubble-like" members, can be used without departing from the novel scope of the present invention. It will also be understood that while the illustrative embodiment shows that both cover-sections are transparent, one of the cover-sections can be either translucent or opaque without departing from the novel scope of the present invention. It will also be understood that while sphere sections are shown any three-dimensional shape or shape-section can be used, in place of the spherical sections, without departing from the novel scope of the present invention.

Play feature 12 further comprises a spinner 19 comprises a plurality of hollow tubes 20, each having an end cap 22 and being joined at one end at an axle 24. Handles 26 are attached at both ends of axle 24. A user may grasp either handle 26 and by turning the handle 26, cause spinner 19 to turn freely. Handle 26 may be made in any manner known in the art. As shown in FIGS. 1 and 4, handle 26 may have a number of knurled holding points 26*a* to assist the user in gripping handle 26. It will be understood, by persons having skill in the art, that spinner 19, illustrated as having four tubes 20, may be constructed such that either more or fewer tubes 20 are used. For example, a spinner 19 having a single tube, two tubes, three tubes, five tubes or more can be constructed without departing from the novel scope of the present invention. Further, it will be understood by persons having skill in the art, that a spinner 19 may be constructed with a single handle that is accessible from only one side of the play feature 12; and that the tubes 20 of spinner 19 can be straight, arcuate or have any desirable shape without departing from the novel scope of the present invention.

Figure 2:
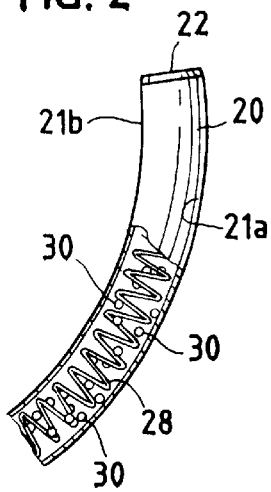
FIG. 2 is a perspective view, partially cut-away, showing the internal elements of the tubular member of the present invention.

Referring now to FIG. 2, one of the hollow tubes 20 is shown partially broken away. Hollow tube 20 is comprised of a continuous wall 21, having an interior side-wall 21*a* and exterior side wall 21*b*. It will be understood by persons having ordinary skill in the art that hollow tubes 20 may be made of any durable material without departing from the novel scope of the present invention.

Figure 3:
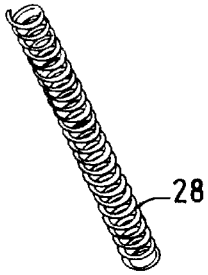
FIG. 3 is a perspective view of the interference member of the present invention.

Within hollow tube 20 an interference member 28 is placed unattached, such that it may slide against and/or strike the interior wall 21*a*. As shown (most particularly in FIGS. 2 and 3), in a preferred embodiment, interference member 28 is a helically shaped spring-like member. In a preferred embodiment, interference member 28 is constructed of a metal material, such that interference member 28 is durable and can withstand being struck and can strike the interior wall 21*a* and end cap 22 without breaking. In another embodiment, the interference member 28 is constructed of hard plastic, having a similar effect as if it were made of metal. It will be understood, by persons having skill in the art, that interference member 28 may be constructed of any material that is durable and demonstrated similar desired properties, without departing from the novel scope of the present invention. It will also be understood that interference member 28 can take a form, other than helically-spring shaped, without departing from the novel scope of the present invention.

In a preferred embodiment of the present invention, tube 20 is also provided with a plurality of small noise making bodies 30. In a preferred embodiment, small noise making bodies are spherically shaped balls or beads. In a preferred embodiment, bodies 30 are metal spheroidical bodies often referred to as "BB's". In one embodiment, bodies 30 are constructed of plastic, of a type similar to that used to construct a preferred embodiment of interference member 28. It will be understood that while metal is a preferred material, any material demonstrating similar desirable properties can be used without departing from the novel scope of the present invention.

In the operation of play feature 12, the interference member 28 and a desirable number of beads 30 are placed within tubes 20 and the ends of the tubes are sealed, in a manner well known in the art. The beads 30, interference member 28 and interior walls 21*a* of tube 20 all can freely contact, interact and are associatable with one another. When handles 26 are turned, and play feature 12 is caused to spin, hard plastic beads 30 can strike interference member 28 and the interior walls 21*a* of tubes 20 in such a manner as to cause a desirable sound. The bouncing of beads 30 against interference member 28 and wall 21*a,* and against other beads 30 adds to the desired sound. It has been found that, by using the preferred materials, the play feature 12, when spun, causes a sound similar to that heard during a rain storm.

It will be understood, by persons having skill in the art, that while certain materials are described as being preferred for various elements of play feature 12, other materials may be used and/or the materials expressed may be reversed, such that the materials preferred are still used on and within the device so that the preferred sounds, created by the striking of items made with the preferred materials against each other, can still be made.

Although an illustrative embodiment of the invention has been shown and described, it is to be understood that various modifications and substitutions may be made by those skilled in the art without departing from the novel spirit and scope of the invention.

What is claimed is:

1. A playground entertainment feature, comprising:

at least one tubular member, having internal walls defining an internal space, the at least one tubular member being journaled to a central axis;

the internal space housing a helically shaped interference member and a plurality of small noise members therein, the interference member and the small noise members being able to freely contact one another, within the at least one tubular member such that when the at least one tubular member is rotated about the central axis the small noise members and the interference member collide with each other and the inner walls of the at least one tubular member to create sounds.

2. A playground entertainment feature, comprising:

at least one tubular member, having internal walls defining an internal space, the at least one tubular member being journaled to a central axis;

the central axis having a first end and a second end and including a first handle at the first end of the central axis and a second handle at the second end of the central axis such that a user may cause the axis to turn by turning either the first or second handle;

the internal space housing an interference member and a plurality of small noise members therein, the interference member and the small noise members being able to freely contact one another, within the at least one tubular member such that when the at least one tubular member is rotated about the central axis the small noise members and the interference member collide with each other and the inner walls of the at least one tubular member to create sounds.

3. A playground entertainment feature, comprising:

at least one tubular member, having internal walls defining an internal space, the at least one tubular member being journaled to a central axis;

the internal space housing an interference member and a plurality of small noise members therein, the interference member and the small noise members being able to freely contact one another within the at least one tubular member such that when the at least one tubular member is rotated about the central axis the small noise members and the interference member collide with each other and the inner walls of the at least one tubular member to create sounds; and, a transparent housing surrounding the tubular member and axis.

4. A playground entertainment feature, comprising:

at least one tubular member, having internal walls defining an internal space, the at least one tubular member being journaled to a central axis;

the internal space housing an interference member and a plurality of small noise members therein, the interference member and the small noise members being able to freely contact one another, within the at least one tubular member such that when the at least one tubular member is rotated about the central axis the small noise members and the interference member collide with each other and the inner walls of the at least one tubular member to create sounds; and, a frame element, having a first and second side, for supporting the tubular element and the central axis, a transparent housing, comprising a partial-spherical element, the partial-spherical element defining a first opening for attachment to the first side of the frame and defining an opening opposite the first opening such that the central axis is accessible through the transparent housing, so that the central axis may be turned with the tubular member inside the housing.

5. The playground entertainment feature of claim 4, including a second partial spherical element on the second side of the frame.

6. The playground feature of claim 4, wherein the central axis has a first end and a second end and including a first handle, extending outside of the transparent housing, at the first end of the central axis and a second handle, outside of the transparent housing, at the second end of the central axis such that a user may cause the axis to turn by turning either the first or second handle.

7. A playground entertainment feature, comprising:

four tubular member, made of metal, having internal walls defining an internal space, the tubular member placed 45 degrees apart from each other and journaled to a central axis;

the internal space of each tubular member, housing a helically shaped interference member and a plurality of small spheroids therein, the helically shaped members and the spheroids being freely placed within each of the tubular members such that when the central axis is turned, the tubular members rotate about the central axis and the spheroids collide with the helically shaped members, in each tubular member, and the inner walls of the tubular members to create sounds;

a frame element, having a first and second side, for supporting the tubular element and the central axis;

a transparent housing, comprising a partial-spherical element, the spherical element defining a first opening for attachment to the first side of the frame and defining an opening opposite the first opening such that the central axis is accessible through the transparent housing, so that the central axis may be turned with the tubular member inside the housing.

8. The playground entertainment feature of claim 7, wherein the spheroids are made of metal and the sounds created by the turning of the central axis is similar to those of rain.

9. The playground entertainment feature of claim 7, including a handle attached to the central axis, such that the turing of the handle causes the axis to turn.

10. The playgroung entertainment of claim 7, wherein the central axis has a first end and a second end and including a first handle at the first end of the central axis and a second handle at the second end of the central axis such that a user may cause the axis to turn by turning either the first or second handle.

* * * * *